United States Patent [19]

Gourdine

[11] Patent Number: 4,498,631

[45] Date of Patent: Feb. 12, 1985

[54] ELECTROGASDYNAMIC COATING SYSTEM

[75] Inventor: Meredith C. Gourdine, East Orange, N.J.

[73] Assignee: Energy Innovations, Inc., East Orange, N.J.

[21] Appl. No.: 447,478

[22] Filed: Dec. 6, 1982

Related U.S. Application Data

[62] Division of Ser. No. 310,534, Oct. 13, 1981, Pat. No. 4,433,003.

[51] Int. Cl.[3] ..... B05B 5/00

[52] U.S. Cl. ..... 239/692; 239/704; 239/706; 239/398; 239/424; 118/629; 261/122

[58] Field of Search ..... 239/692, 690, 691, 697, 239/698, 704, 705, 706, 707, 424, 398; 261/123, 122; 118/629

[56] References Cited

U.S. PATENT DOCUMENTS

| | | | |
|---|---|---|---|
| 47,679 | 5/1865 | Dunscob | 261/123 |
| 616,997 | 1/1899 | Whitney | 261/123 |
| 3,519,855 | 7/1970 | Gourdine | 310/10 |
| 3,589,607 | 6/1971 | Wolf et al. | 239/705 |
| 3,630,441 | 12/1971 | Felici | 239/692 |
| 3,670,961 | 6/1972 | Tholome | 239/692 |
| 3,673,463 | 6/1972 | Gourdine | 317/3 |
| 3,757,491 | 9/1973 | Gourdine | 55/107 |
| 3,791,579 | 2/1974 | Cowan | 239/692 |
| 3,870,233 | 3/1975 | Wilhelm | 239/692 |
| 3,991,709 | 11/1976 | Gourdine et al. | 118/634 |
| 3,991,710 | 11/1976 | Gourdine et al. | 239/692 |

FOREIGN PATENT DOCUMENTS

| | | | |
|---|---|---|---|
| 2029271 | 3/1980 | United Kingdom | 239/691 |

OTHER PUBLICATIONS

Powell et al., Vapor Deposition, John Wiley and Sons, N.Y., N.Y., p. 269.
Finishing Highlights, Jul./Aug., 1978, p. 48.
Automotive Industries, Jun. 15, 1973.
Estey Electrogasdynamic Powder Coating Systems.

*Primary Examiner*—Richard Bueker
*Attorney, Agent, or Firm*—James V. Tura; Robert E. McDonald; Thomas E. Kocovsky, Jr.

[57] ABSTRACT

The electrogasdynamic coating system includes an electrogasdynamic gun for charging material particles indirectly. The gun has a gas inlet which receives from a gas source a pressurized gas in which an condensable vapor is entrained. Corona and attractor electrodes are disposed in communication with the gas inlet for ionizing the ionizable vapor. A dielectric tube extends from the electrodes downstream to a mixing chamber. A first fluid material inlet is connected with a first source of powder or liquid material and a second fluid material inlet is connected with a second source of powder or liquid material. The first and second fluid material inlets are connected with the mixing chamber such that particles of the first and second fluid materials are mixed with the gas and vapor. The vapor condenses and coats the particles during mixing causing them to become charged. In use, a condensable vapor is entrained into a gas flow, the gas flow is passed across corona and attractor electrodes to ionize the vapor. The ionized vapor condenses and is mixed with first and second fluid material particles such that the particles become charged. In this manner, the particles become charged without coming in contact with the corona or attractor electrode.

14 Claims, 9 Drawing Figures

ELECTROGASDYNAMIC COATING SYSTEM

This is a division of application Ser. No. 310,354, filed Oct. 13, 1981, now U.S. Pat. No. 4,433,003.

BACKGROUND OF THE INVENTION

This application pertains to the art of spray coating and more particularly to electrogasdynamic coating systems. The invention is particularly applicable to applying protective, finish coatings to workpieces and will be described with particular reference thereto. It is to be appreciated, however, that this invention has broader applications and finds utility in many manufacturing processes including the precise formulation of constituent components of liquid and powered products, depositing intermediary layers of materials during an industrial manufacturing process, adding lubricants, quenching metals, and the like.

As expanded in more detail in my earlier U.S. Pat. No. 3,519,855, issued July 1970, electrogasdynamics involves the ionization of a moving stream of air or other gas which contains ionizable substances. The ionized substance forms an ionized or charged cloud which tends to repel subsequently ionized portions of the substance. This repulsion acts to convert fluid potential or kinetic energy of the gas containing the ionized substance into a higher electrostatic potential of the ionized substance. As set forth in my earlier U.S. Pat. No.3,673,463, issued June 1972, the electrogasdynamic principles find utility in combination with coating systems. Air in which particles of a selected coating material are entrained is passed through corona and attractor electrodes for imparting an electrostatic charge to the entrained coating materials. The workpieces to be coated are grounded or given an opposite electrostatic charge to attract coating material particles and form a smooth, even coating. As used herein, particles is used to connote solid powders and liquid droplets. As disclosed in U.S. Pat. No. 3,991,710, issued November 1976, of which I am a co-inventor, electrogasdynamic spray guns are particularly adapted for use in continuous production line coating systems. In such a coating system, the electrogasdynamic guns produce a cloud of charged coating particles through which the workpieces to be coated are moved. To prevent the charged cloud of coating materials from escaping the coating area, an elongated precipitation section with exhaust sections at one or both ends is provided.

Heretofore, electrogasdynamic guns passed the coating material particles directly over the corona and attractor electrodes. One of the problems with direct ionization of the coating particles resides in the tendency for the particles to coat the electrodes, particularly the attractor electrode. As the electrode becomes coated, the corona current decreases, the charge which the coating particles receive decreases, and the coating efficiency of the overall system decreases.

Another problem with the prior art electrogasdynamic coating systems resides in the length of the precipitator section. To prevent particles from leaking out of the system, a relatively long precipitator section was employed. However, when the precipitator section is longer than the distance between workpieces, changing coating colors or materials is difficult. Particularly, adjacent parts cannot be painted different colors without an intermixing of the colors unless the workpieces are spaced further apart than the length of the elongated precipitator section.

SUMMARY OF THE INVENTION

The present invention contemplates a new and improved electrogasdynamic gun, coating system, and method which overcomes the above-referenced problems and others. It provides an electrogasdynamic gun, system, and method which require little maintenance, require little cleaning of the electrodes, and are readily adapted to changing coating materials quickly.

In accordance with the present invention, there is provided a method of spraying comprising: entraining a condensable vapor into a gas flow, ionizing and condensing the vapor by causing the gas to flow past corona and attractor electrodes.

In accordance with another aspect of the invention, there is provided an electrogasdynamic apparatus which includes a gas inlet which is adapted to receive pressurized gas saturated with condensable vapor. Corona and attractor electrodes are disposed in communication with the gas inlet for ionizing the vapor. A fluid material inlet receives particles of a fluid material. A mixing chamber is disposed downstream from the electrodes and is operatively connected with the fluid material inlet for mixing the fluid and the gas entrained with ionized vapor such that the fluid becomes charged and is carried from the mixing chamber with the gas.

A primary advantage of the present invention is that the fluid material particles or droplets are charged indirectly. Keeping the fluid material out of contact with the electrodes reduces maintenance and assists in maintaining ionizing or charging efficiency.

Another advantage of the present invention is that it facilitates changing from one material or color to another quickly.

Yet another advantage of the present invention resides in its versatility. It is readily adapted to handle a wide variety of fluids including liquid droplets, powdered solids, or both droplets and powders.

Still further advantages will become apparent upon reading and understanding the following detailed description of the preferred embodiment.

BRIEF DESCRIPTION OF THE DRAWINGS

The invention may take form in various parts or arrangements of parts or in various steps and arrangements of steps. The drawings herein are only for the purpose of illustrating a preferred embodiment of the present invention and are not to be construed as limiting the invention.

DESCRIPTION OF THE PREFERRED EMBODIMENT

Figure 1:
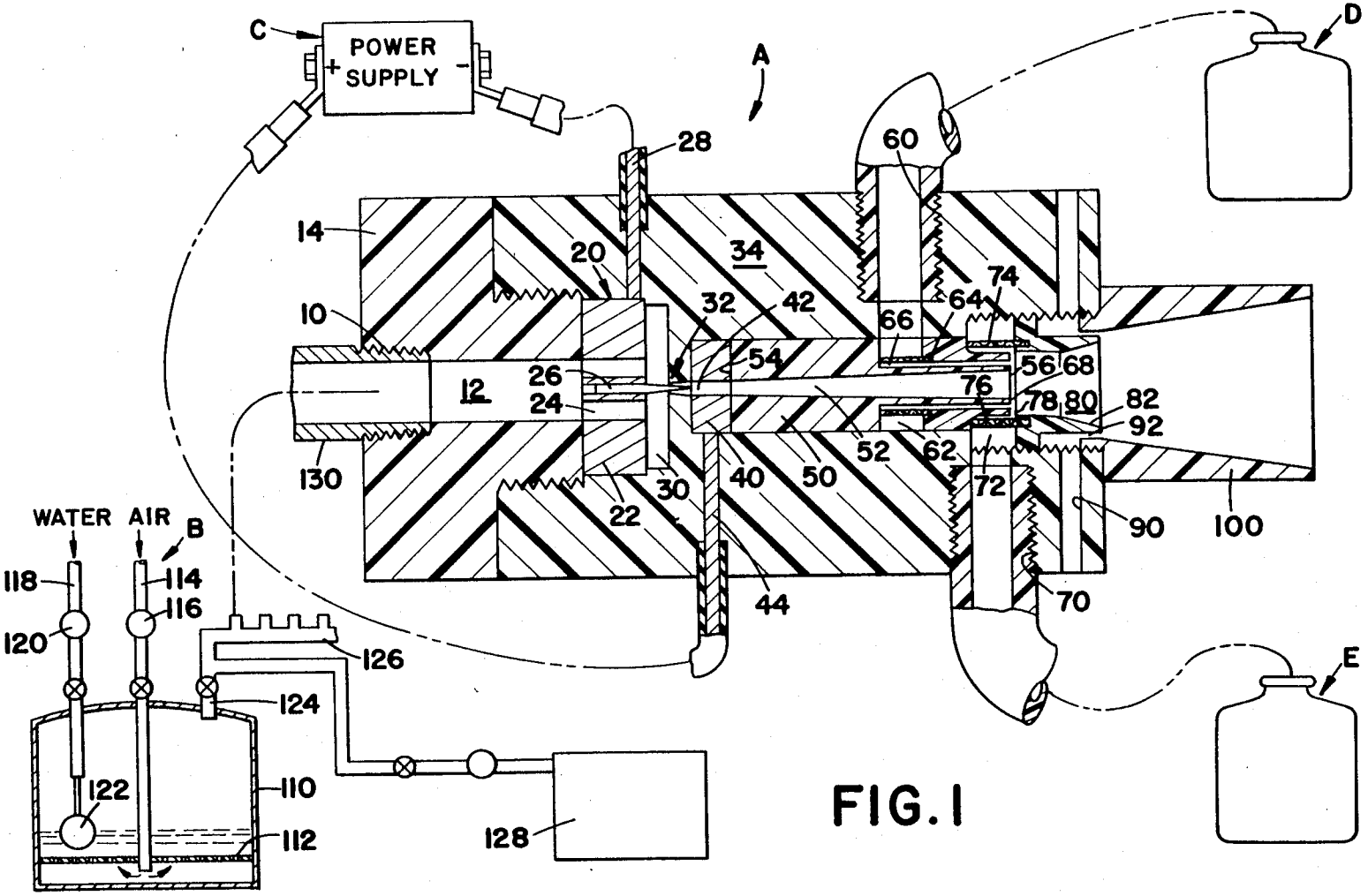
FIG. 1 is a diagrammatic illustration of an electrogasdynamic system including an electrogasdynamic gun in section in accordance with the present invention.

With reference to FIG. 1, there is illustrated an electrogasdynamic coating system including an electrogasdynamic gun A. The gun A receives under pressure a flow of gas with a condensable vapor entrained therein from a gas supply means B. A power supply C provides an electrical potential to the gun A for ionizing the vapor. A first fluid material supply means D supplies particles of a first fluid material which are indirectly charged by the gun A and discharged in the gas flow. A second material supply means E supplies particles of a second material which are indirectly charged by the gun A and discharged in the gas flow.

With continued reference to FIG. 1, the electrogasdynamic gun A has a gas inlet 10 for receiving the gas flow. A gas inlet passage 12 through an electrically nonconductive rearward housing portion 14 connects the gas inlet 10 with a corona electrode assembly 20. The corona electrode assembly includes an electrically conductive disc 22 which has a plurality of orifices 24 in communication with gas inlet passage 12. Disposed in the center of the disc 22 surrounded by the orifices 24 is a metallic needle or corona electrode 26. An electrical conductor, brushes, or other appropriate electrical connection means 28 interconnects the disc 22 with the power supply C. In the preferred embodiment, the electrical conductor means 28 connects the corona electrode assembly with a ground or negative side of the power supply.

An enlarged annular passage 30 provides a gas flow path from the orifices 24 to a constricted throat portion 32 which surrounds the corona electrode 26. The throat portion 32 accelerates the gas, preferably to supersonic velocities. The annular passage 30 and the throat portion 32 are defined by an electrically nonconductive forward housing portion 34. Adjacent the throat, a passage through the throat portion diverges about 3° which is not so large that the gas flow seperates from the passage surface nor too small to compensate for functional losses.

Disposed adjacent the throat portion 32 is an attractor electrode 40. The attractor electrode is an annular disc having an electrode passage 42 which is larger in transverse section than the throat portion 32 allowing the gas to expand. An electrical conductor, brush, or other appropriate electrical connection means 44 connects the attractor electrode 40 with the power supply C. In the preferred embodiment, the power supply supplies the attractor electrode a positive electrical potential relative to the corona electrode 26.

Adjacent the attractor electrode passage 42 is a dielectric tube 50 having a divergent internal passage 52 extending from a first end 54 adjacent the attractor electrode to a second end 56. The dielectric tube 50 is constructed of MYLAR, boron nitride, or other suitable dielectric material. Kinetic energy or fluid potential is converted into electrical potential in the dielectric tube passage by the work performed in sweeping the charged ions downstream against the electrostatic repulsive force of charged ions already disposed downstream. The dielectric tube internal passage 52, in the preferred embodiment, has an aspect ratio, i.e., the ratio of its longitudinal length to its transverse diameter, of at least 2.5 to 1 to provide an effective conversion from kinetic to electrostatic energy and has a full angle of divergence of at last 1.2° in order to compensate for losses due to friction and to minimize loss of charge to the passage surface.

Disposed within the nonconductive forward housing portion 34 is a first fluid material inlet 60 for receiving a first fluid material to be entrained into the ionized gas flow. The first fluid material inlet 60 is connected with a first fluid material passage including an outer annular region 62. A screen or filter 64 separates the outer annular region 62 from an inner annular region 66 of the first material passage. The inner annular region 66 extends along the exterior of the dielectric tube 50 and terminates adjacent the dielectric tube second end 56 at a first fluid material entraining outlet 68. The flow of the first material along the exterior of the dielectric tube 50 tends to collect and dissipate any static charge which might collect from the charged ions flowing through internal passage 52.

Also disposed in the nonconductive forward housing portion 34 is a second fluid material inlet 70. The second fluid material inlet 70 connects with a second material passage including an outer annular region 72, a screen 74, and an inner annular region 76. The inner annular region has an annular second material entraining outlet 78 adjacent the dielectric tube second end 56.

A mixing chamber 80 is defined by tubular insulating element 82 which is disposed adjacent the dielectric tube second end. The mixing chamber 80 has a greater transverse cross section than the transverse cross section of the dielectric tube internal passage 52. The change in cross section drops the pressure of the gas flow which draws the first and second fluid materials through the entraining outlets 68 and 78 into the mixing chamber. The expansion of the gas downstream from the throat portion 32 and the pressure drop tends to cause the ionized vapor to condense into charged droplets which become mixed in the mixing chamber 80 with and coat particles of the first and second fluid materials. The increase in cross section further causes a decrease in the gas flow rate which causes turbulence to assist in intermixing the first and second fluid materials with the gas flow and condensed charged droplets.

The nonconductive forward housing portion 34 further has a plurality of air passages 90 which terminate at an annular area 92 around the discharge end of the mixing chamber 80. Disposed adjacent the mixing chamber is a divergent nozzle 100 which has a greater transverse cross section than the mixing chamber. This draws air through passages 90 and 92 into the flow and causes more turbulence and mixing of the first and second fluid materials with the gas flow and condensed, charged droplets.

With continued reference to FIG. 1, the gas supply means B includes a reservoir 110 which has a perforated baffle 112 disposed horizontally a small distance from its lower surface. A carrier gas inlet 114 including a regulator valve 116 conveys the gas to the region below the perforated baffle 112. A condensable vapor inlet 118 including a regulator valve 120 and a float valve 122 maintains a pool of the vapor in condensed, liquid form in the reservoir 110 at a predetermined level above the perforated baffle. As the carrier gas bubbles through the perforations the baffle 112 and rises in the condensate, the bubbles become saturated, preferably supersaturated, with the condensable vapor. Because the exact level of saturation varies with temperature and pressure, the amount of vapor entrained in the gas can be selected by adjusting the temperature of the condensate and the pressure in the tank 110. The gas saturated with vapor is conveyed through a reservoir outlet 124 to a manifold 126. Connected with the reservoir outlet is a turbogenerator 128. A gas conveying conduit 130 connects one of the manifold outlets with the gas inlet 10 of gun A. The other manifold outlets may be blocked off or connected with additional guns.

In operation the carrier gas, air in the preferred embodiment, is pumped under pressure into the carrier gas inlet 114. The air bubbles through the condensate, water in the preferred embodiment, and becomes saturated with water vapor. The air entrained with water vapor flows under pressure to the gas inlet 10 and inlet passage 12 of the gun A. As the gas flows through orifices 24, annular passage 30, and throat 32 to electrode passage 42, the water vapor is ionized by the corona emissions surrounding the corona electrode 26. In the preferred embodiment, the pressure of the gas is selected such that the gas flow rate reaches supersonic velocity as it passes through throat 32 and electrode passage 42. This causes submicron size charged droplets to be formed as the vapor condenses on molecular ions, increases turbulence in the mixing chamber, and improves the performance of the gun. The charge on previously charged ions located downstream of the dielectric tube 50 forms an electrostatic field that resists the flow of charged droplets through the dielectric tube passage 52. This electrostatic field causes the charged droplets in the dielectric tube passage 52 to acquire a greater charge at the expense of their kinetic energy before they exit from the dielectric tube second end 56. As the gas flows into the mixing chamber 80, it aspirates particules of the first and second fluid materials into the mixing chamber and the turbulence causes them to intermix. With the expansion of the gas and the drop in pressure, the ionized water vapor tends to condense and coat the particles imparting a charge to them. As stated above, particles is used herein to connote both solid powders and liquid droplets. If the particles of one of the materials are missible or reactive with the condensed vapor or the particles of the other material, the components may mix or react in the mixing chamber. The flow rate decreases in nozzle 100 which increases the turbulence, intermixing and reacting of the components. As the charged particles exit nozzle 100, they tend to form the electrostatically repulsive electrostatic field by forming a charged cloud.

Figure 2:
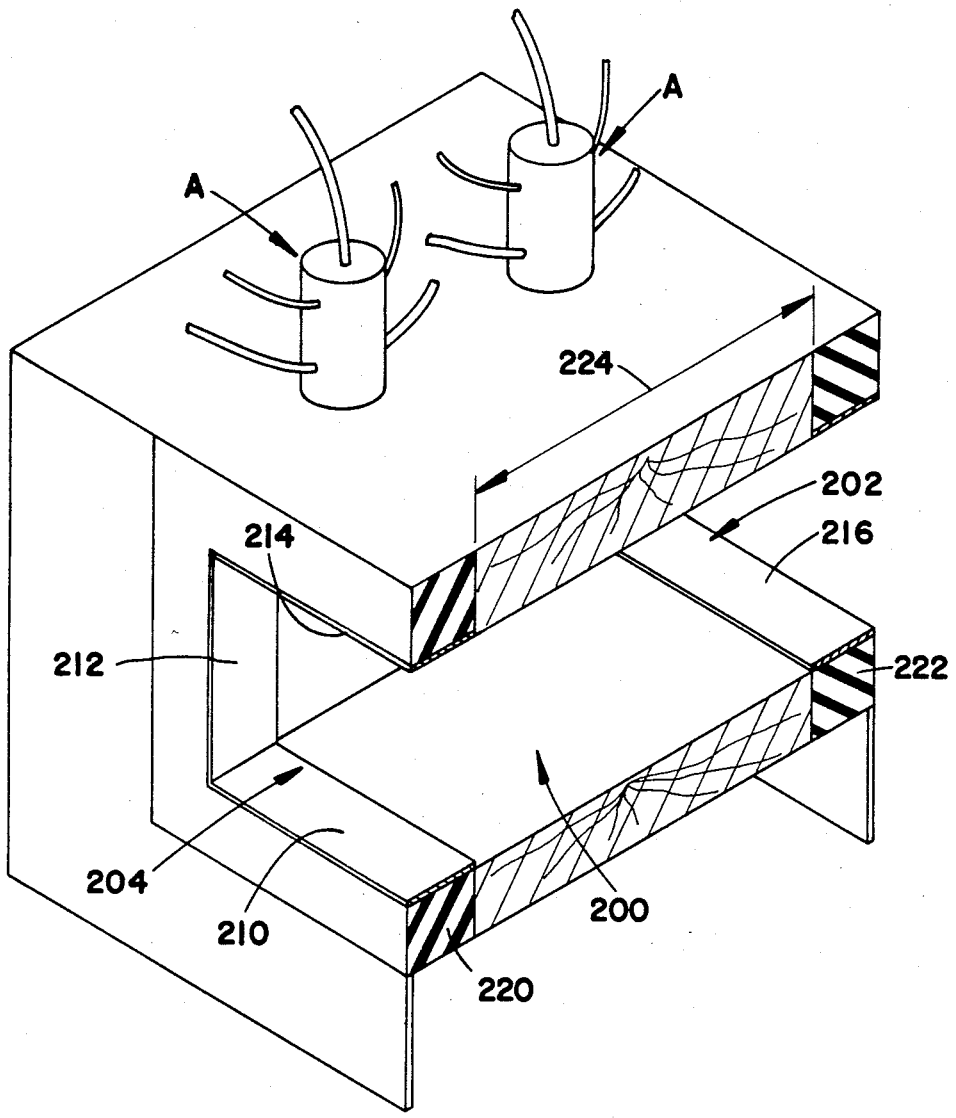
FIG. 2 is a perspective view in partial section of a coating chamber in accordance with the present invention.

With reference to FIG. 2, a coating chamber for use in conjunction with the electrogasdynamic gun A of FIG. 1 is illustrated. The chamber includes a coating region 200 which is surrounded by the chamber. On two opposing sides, inlet and outlet openings 202 and 204 are provided. To permit the workpieces which are to be coated but to prevent charged coating particles from passing through the openings 202 and 204, charged particle repelling means are provided at the inlet and outlet openings. The charge particle repelling means include sheets 210, 212, 214, 216 and others not shown in FIG. 2 of conducted metal which surround the openings 202 and 204. Disposed below the conductive sheets are insulator layers 220 and 222 of rubber or the like for isolating any charge which accumulates on the conductive sheets. When the guns A start spraying charged fluids or particles into the coating region 200, the conductive sheets quickly acquire an electrostatic charge which repels the charged particles. In this manner, the charged coating particles are repelled from the inlet and outlet openings and retained within the coating region 200. The workpieces to be coated, by distinction, are grounded such that they attract the charged particles. It will be appreciated that the turbulence of the charged particle cloud assists the charged particles in covering the surfaces of the grounded workpieces uniformly including deep recesses and convex portions. The workpieces to be coated are conveyed, generally hanging, along a conveyor through the coating chamber 200. Preferably, the length 224 of the coating chamber is equal to or greater than the length of the workpiece to be coated. If necessary to dissipate the kinetic energy of the charged particles emitted from the guns A, the dimensions of the coating chamber may be increased.

With reference to FIGS. 3A–3E, to develop the full static charge on the coating fluids or particles, as indicated above, it is necessary to establish the charged cloud of particles to provide a repulsive electrostatic force acting against the particles being ejected from the gun. In the present invention, because the electrostatic charge is established on an intermediate substance, e.g., water droplets, the charged cloud can be established and maintained in the absence of the coating material. This feature enables the present invention to change coating materials or colors without the lengthy process of clearing the coating chamber and reestablishing the charged cloud. FIGS. 3A through 3E illustrate a preferred embodiment of a method of painting adjacent workpieces different colors in conjunction with an automobile body production line. It will be appreciated, however, that the principles illustrated in FIGS. 3A–3E are equally applicable to other workpieces and production lines.

Figure 3A:
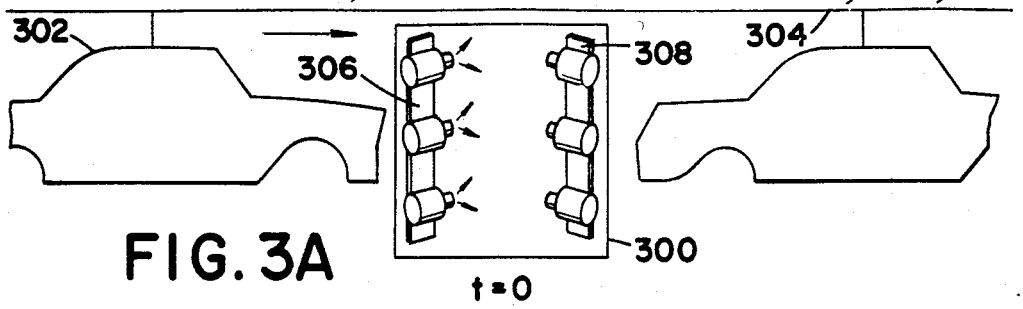
FIGS. 3A–3E are a series of diagrammatic illustrations of a coating system and method in accordance with the present invention in combination with a continuously moving production line.

Referring to FIG. 3A, a coating chamber 300 is disposed for coating workpieces 302 which are carried downstream along a conveyor 304. By way of example, in the automotive industry, the workpieces or automotive bodies, are about 12 feet long, spaced about 5 feet apart, and move at about 30 feet per minute. The coating chamber 300 has a length which is equal to or less than the interworkpiece spacing, in the example 5 feet. Further to the present example, a workpiece begins entering the upstream end of the coating chamber 300 every 34 seconds. The coating chamber 300 has an upstream bank of guns 306 and a downstream bank of guns 308. Each of the guns is selectively connectable by an electrically operated valving means with the same plurality of coating materials. By operating the electrical valving means, the guns in the upstream bank 306 as well as the guns in the downstream bank 308 may be disconnected from all coating materials to spray only water or other condensable vapor droplets, may be connected with the same coating material, or with different coating materials.

With continued reference to FIG. 3A, before the first workpiece 302 enters the coating chamber, the upstream bank of guns 306 sprays charged water droplets to establish the charged cloud. Still while the chamber is empty of workpieces the downstream guns are deactivated and the downstream portion of the coating chamber is exhausted with clean air.

Figure 3B:
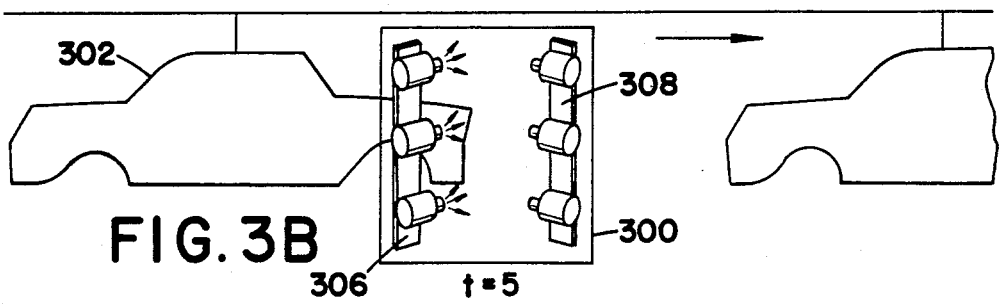

Referring to FIG. 3B, the workpiece 302 enters the upstream side of the coating chamber and its front end reaches the center of the coating chamber, in the present example at about 5 seconds after entering the coating chamber. As the first workpiece enters the coating chamber, the upstream bank of guns 306 sprays charged droplets mixed with the coating or paint material into the coating chamber. This forms a cloud of charged coating material about the front of the grounded workpiece which is attracted thereto. At the downstream end of the painting chamber, the clean air exhaust continues withdrawing any particles of the coating material which move toward the downstream end rather than being attracted to the grounded workpiece.

Figure 3C:
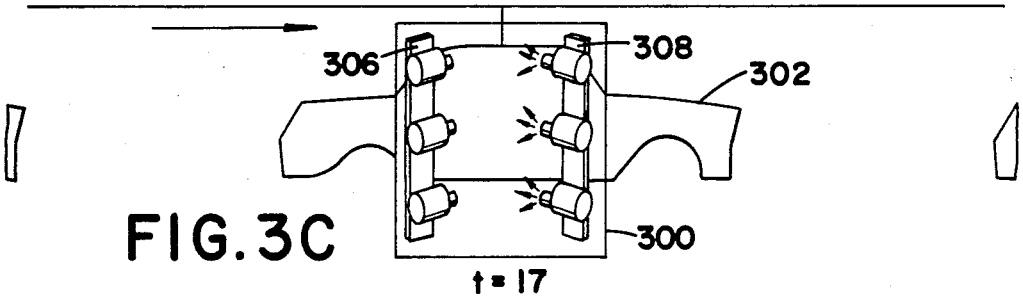

Referring to FIG. 3C, when the workpiece is about halfway through the coating chamber 300 (about 17 seconds after the workpiece entered the coating chamber), the upstream bank of guns 306 shuts off and the downstream bank of guns 308 begins to spray charged water droplets mixed with coating material. This maintains the charged cloud of coating material toward the center of the painting chamber 300 but shifts the cloud toward the downstream end.

Figure 3D:
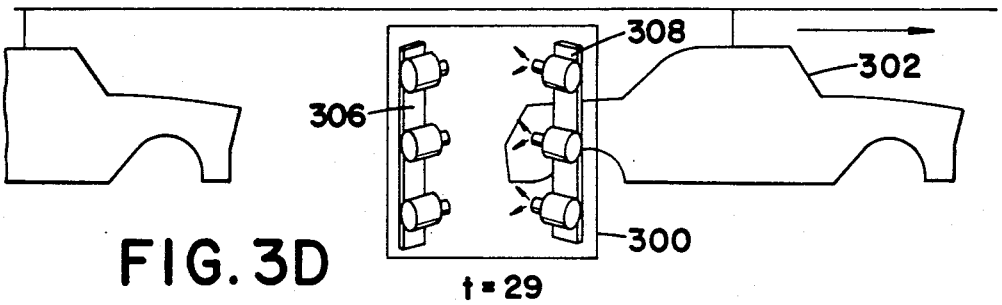

Referring to FIG. 3D, as the first workpiece 302 is exiting the coating chamber (about 29 seconds after entering the coating chamber), the downstream bank of guns 308 begins to spray only charged water droplets without coating material. This maintains the static charged cloud in the coating chamber. The maintenance of the charged cloud within the coating chamber continues to maintain the attraction between the grounded workpiece and the charged coating particles. The upstream bank of guns remain shut off and a clean air exhaust starts to clear suspended coating particles which are near the upstream end of the coating chamber.

Figure 3E:
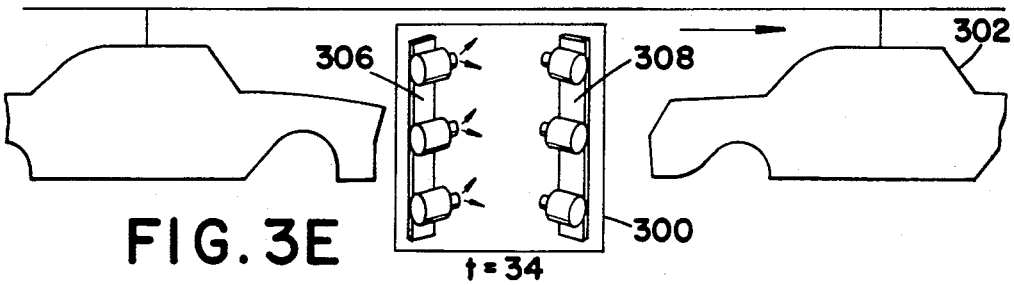

Referring to FIG. 3E, after the first workpiece 302 has exited the coating chamber 300 (about 34 seconds after entering the coating chamber) the upstream bank of guns 306 begin to spray charged water droplets. The cloud of charged water droplets formed by the upstream bank of guns repels the like charged cloud which had been produced by the downstream bank of guns. This repulsion pushes the existing charged cloud, including any suspended coating particles which might be contained in it, toward the downstream side of the coating chamber 300. At the downstream side of the coating chamber a clean air exhaust is commenced to remove any remaining charged coating particles. In this manner, a clean, coating material free charged cloud is established in the coating chamber as the next cycle is commenced.

Figure 4:
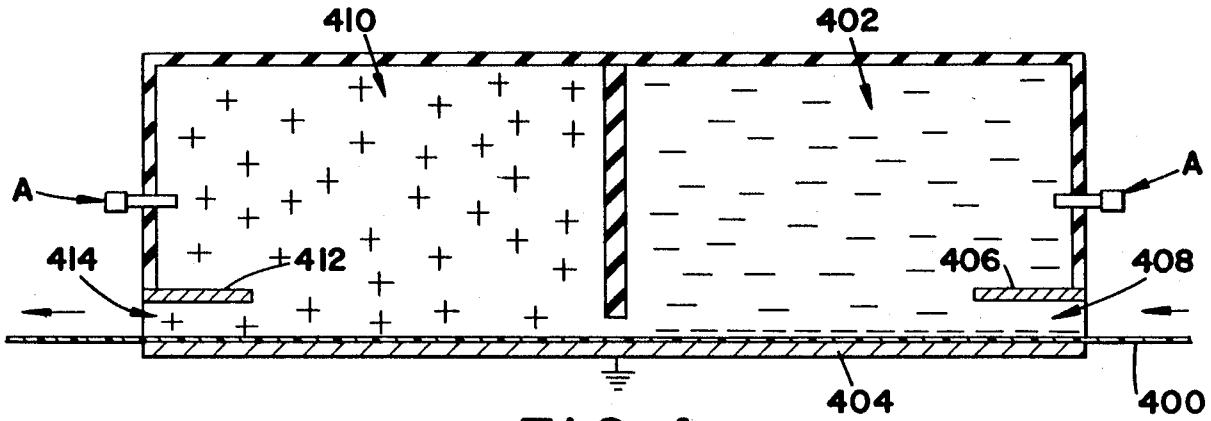
FIG. 4 is a diagrammatic illustration of an electrogasdynamic coating system for coating one side of a continuously moving sheet.

FIG. 4 illustrates coating chambers and methods for coating one side of a film or sheet 400 of material. A first coating chamber 402 has one or more electrogasdynamic guns A which are connected with their associated power supply in such a manner that negatively charged particles are ejected. At the bottom surface of the coating chamber 402 is a grounded metal plate 404 to which the charged particles are attracted. A floating or electrically insulated metal plate 406 extends adjacent a sheet receiving opening 408 of the coating chamber 402. Because the floating plate 406 is electrically insulated, it soon assumes the same charge as the charged cloud in the coating chamber and repels it. This repulsion inhibits the charged particles from escaping through the sheet receiving opening 408. The negatively charged coating material particles which are attracted toward the grounded metal plate 404 form a coating on the sheet of material 400 as it moves through the first coating chamber 402. If only a single layer of material is desired on the sheet 400, the coating operation may be considered finished at this point. Optionally, baking or drying ovens downstream from coating chamber 402 may be utilized to cure or fix the coating material more securely.

In the illustrated embodiment a second layer is to be applied to the sheet 400 by a second coating chamber 410 which is disposed adjacent the first coating chamber 402. In the second coating chamber, an electrogasdynamic gun A is connected with its power supply such that it produces a positively charged cloud of a second coating material. The positively charged coating material particles are similarly attracted towards grounded plate 404 and form a second layer on sheet 400. A floating metal plate 412 adjacent an outlet 414 takes on the positive charge on the ion cloud and repels the charged particles from the outlet. Again, if appropriate to the coating materials, drying or baking ovens may be disposed downstream of the coating chamber 410. Similarly, additional coating chambers and additional baking or drying ovens and the like may be interposed along the route of travel of the moving sheet 400 to form additional layers or perform additional functions as is appropriate to the manufacturing process concerned.

Figure 5:
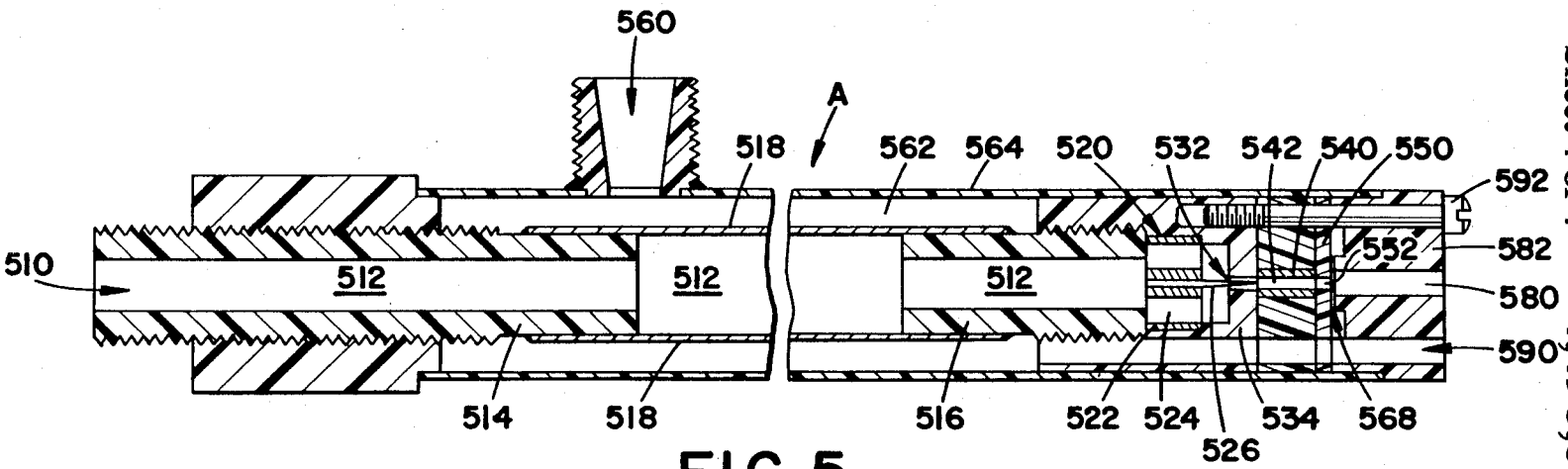
FIG. 5 is an alternate embodiment of an electrogasdynamic gun in accordance with the present invention.

With reference to FIG. 5, an alternate embodiment for an electrogasdynamic gun in accordance with the present invention is illustrated. The gun has a gas inlet 50 for receiving a carrier gas entrained with a condensable vapor. An inlet passage 512 is defined by a housing portions 514 and 516 which are interconnected by a sleeve 518.

A corona electrode assembly 520 is positioned to receive the gas flow from the inlet passage 512. The corona electrode assembly 520 includes a metallic disc 522 with a plurality of gas passing orifices 524 therein. An electrically conductive needle 526 projects from the center of the metallic disc 522 and functions as the corona electrode. A throat portion 532 through which the gas flow passes around the corona electrode is defined by a forward nonconductive housing portion 534. An attractor electrode 540 is disposed adjacent the corona electrode 526. The attractor electrode is a cylindrical metal sleeve having an electrode passage 542 which is slightly larger in transverse cross section with the throat portion 532. As explained in conjunction with the embodiment of FIG. 1, it is preferred that the gas move through throat portion 532 with supersonic velocity. Adjacent the attractor electrode is a foreshortened dielectric tube 550 which surrounds a dielectric passage 552.

A coating material inlet 560 receives the coating material. Although the gun illustrated in FIG. 5 is particularly adapted for spraying a powdered coating material, it is to be appreciated that it is adaptable to spraying liquid and other fluid coating materials as well. The coating material inlet 560 is connected with a cylindrical material passage 562 defined on its innerside by sleeve 518 and on its outerside by an outer sleeve 564. The mateerial passage 562 connects with an aspirator outlet 568 closely adjacent the downstream end of dielectric passage 552. Because the dielectric tube 550 is disposed between the aspirator outlet 568 and the attractor electrode coating material is prevented from depositing on the electrodes.

A mixing chamber 580 defined by a dielectric nozzle member 582 is disposed adjacent the downstream end of dielectric passage 552 and aspirator outlet 568. The transverse cross section of the mixing chamber 580 is greater than the transverse cross section of dielectric passage 552 which causes the gas flow to expand upon entering the mixing chamber and draws the coating material powder through the aspirator outlet 568. As in the embodiment of FIG. 1, this sudden change in the cross section causes turbulence and condensation of the vapor into charged droplets which coat the particles. An air inlet 590 is also connected with the aspirator outlet 568 to permit additional air to be drawn into the mixing chamber 580. An adjusting means 592 in the form of a screw member which is threadingly received in the forward nonconductive housing portion 534 adjusts the width of the aspirator outlet 568 to control the amount of coating material expelled from nozzle portion 582. The mixing chamber 580 and the nozzle portion 582 are particularly adapted for injecting the coating material into the interior of workpieces, particularly tubular workpieces. To this end, the nozzle member 582 has no flared outlet. Rather, the material moving through mixing chamber 580 is maintained at a relatively high flow rate which is abruptly slowed as it leaves the end of the mixing chamber. This causes a turbulent cloud at its outlet while impelling the coating material a relatively long distance into the object to be coated. This renders the gun of FIG. 5 ideally suited for coating the interior of turbular fluorescent lighting tubes with fluorescent powders.

It will be appreciated that the electrogasdynamic gun and spraying system of the present invention finds numerous industrial applications. To convey a full appreciation of the breadth of the present invention, the following examples of these applications are given.

The present invention is suited for producing micro-encapsulated particles. To manufacture such particles, the particle to be micro-encapsulated is conveyed into the gun as the sole material. A vapor of a suitable monomer is entrained in tank 110 into the inlet air flow. The appropriate amount of heat is provided such that as the monomer vapor coats particles in the mixing chamber, the heat causes the thin monomer coating to polymerize. The thickness of the coating is controlled by the temperature of the monomer when it is vaporized and entrained into the air flow. The micro-encapsulated particles are collected on a suitable grounded surface on which they may be either permanently retained or releasably retained and collected for other uses.

Another use for the electrogasdynamic guns of the present invention is to produce precise liquid formulations such as paints and the like. To produce liquid paints, the paint product solvent is vaporized and entrained in the air flow. A powdered pigment is introduced through one of the first or second material inlets and the selected resin is introduced through the other. The resin, preferably, is in a liquid state either through heating or through dissolving in a solvent. If a powdered paint is to be manufactured, the amount of solvent is minimized and the particles ejected from the gun are dried by vaporation in hot air before being collected on a suitable grounded surface.

As discussed in conjunction with FIG. 4, the invention may be used to coat various sheet materials. For example, electro-luminescent panels can be manufactured. An appropriate monomer is vaporized and entrained in the air flow and the selected phosphor is pneumatically drawn through the first material passage into the mixing chamber. The monomer coated phosphor is ejected from the gun to form a coating on a metallic, e.g., aluminum, sheet. Optionally, an epoxy resin may be introduced through the second material passage into the mixing chamber to form an epoxy-phosphor coating. After the phosphorous coating is baked in an infrared oven, a second coating of an electrically conductive material is deposited in a second coating chamber on the first coating. In the preferred embodiment, the second coating layer is formed by entraining a monomer in the air flow and introducing gold, indium oxide, or other conductive material powder into the mixing chamber through the material inlet passage. After the sheet is baked a second time, a layer of clear epoxy is applied in the same manner in a third coating chamber. To apply the epoxy, a suitable monomer is entrained in the air flow and a fine powder of epoxy is introduced into the mixing chamber through the material inlet passage. After application of the epoxy, the product is again baked in an oven. In this manner, continuous sheets of electro-luminescent panels are produced.

Another application in which sheets of material are coated is in the production of photographic film. To make photographic film, a sheet of clear plastic material or film base is fed through coating chambers similar to those illustrated in FIG. 4. In the first coating chamber 402, silver halide grains are aspirated into the mixing chamber of the gun and sprayed onto the plastic film. In the second coating chamber, the appropriate liquid sensitizer chemicals and the appropriate gel in a liquid state are aspirated into the mixing chamber of the gun and sprayed onto the plastic film and silver halide layer. Optionally, a latex powder may replace the conventional photographic gel.

As discussed in conjunction with FIG. 5, the present invention is also suitable for coating the interior of articles, particularly tubular articles. If the articles are conductive such as metal cans, the articles are grounded. If the articles are nonconductive such as incandescent lightbulbs or fluorescent light tubes, two sets of guns may be used. One set of guns disposed closely adjacent an entrance to the workpiece interior sprays charged coating material with a first polarity of charge and a second set of guns sprays the exterior object with charged water droplets with the opposite polarity.

To coat the interior of a can, the vapor is water vapor and the coating material is powdered epoxy. The gun sprays the charged epoxy particles into the interior of the can and the can is baked in an oven. Alternately, a liquid monomer-activator may be entrained in the gas to eliminate the baking step. In coating the interior of lightbulbs, the condensable vapor is water vapor and the coating material is the appropriate phosphor powder. The charged phosphor powder is sprayed into the interior of the lightbulb as other guns maintain a charged water droplet cloud of the opposite polarity around the exterior of the bulb to attract the internal coating to the walls of the bulb.

The present invention is particularly advantageous for quenching hot metals with charged water droplets. The hot metal work piece is grounded to attract the charged droplets to its surface. Because each droplet has a relatively small mass and electrostatically adhers to the metal, each droplet is quickly heated to its boiling point, evaporated, and superheated to the temperature of the metal. The superheating of each droplet causes a unit mass of water to carry away more heat than in prior act water baths and sprays.

The present invention further finds other industrial applications such as coating hypodermic needles with charged clouds of lubricants and the like.

The invention has been described with reference to the preferred embodiment. Clearly modifications and alterations will occur to others upon reading and understanding the preceding detailed description. It is my intention to include all such modifications and alterations which come within the scope of the appended claims or the equivalents thereof.

Having thus described my preferred embodiments, I now claim my invention to be:

1. An electrogasdynamic apparatus comprising:

a gas inlet adapted for receiving pressurized gas having a condensable vapor entrained therein;

corona and attractor electrodes disposed in communication with said gas inlet for ionizing said vapor such that ionized vapor passes downstream therefrom:

a dielectric tube having an unobstructed dielectric passage therethrough extending unobstructed downstream from the corona and attractor electrodes to a downstream end;

a first material inlet for receiving a first fluid material, the first material inlet terminating adjacent the dielectric tube downstream end in a first material entraining outlet in communication with a mixing chamber, whereby the first material is prevented from contacting the electrodes; and, said mixing chamber in communication with, linearly aligned with and disposed downstream from said dielectric tube downstream end said mixing chamber having an unobstructed mixing chamber outlet opening in communication with the atmosphere outside the apparatus at a mixing chamber outlet end and having an unrestricted transverse cross section which is larger than a transverse cross section of the dielectric passage, such that an unobstructed line of sight path without inward projections or obstructions is defined from said electrodes through at least said dielectric passage, said mixing chamber and to the atmosphere outside the apparatus, such that a pressure drop occurs (a) causing first fluid material to be aspirated from the first material entraining outlet, (b) causing turbulence which mixes the first material with said gas entrained with ionized vapor, and (c) causing the ionized vapor to condense on the first material such that said first material becomes charged and is carried from the mixing chamber with the gas.

2. The electrogasdynamic apparatus as set forth in claim 1, wherein the gas inlet is operatively connected with a source of gas saturated with condensable vapor including:

a tank having a gas inlet, a condensed vapor inlet, and a saturated gas outlet, a condensed vapor level controlling means for maintaining a generally constant level of condensed vapor in the tank, the condensed vapor level controlling means being operatively connected with the condensed vapor inlet, a gas inlet tube extending from the gas inlet below the condensed vapor level such that the gas bubbles through the condensed vapor, a gas regulator valve operatively connected with the gas inlet for selectively controlling a rate at which the gas bubbles through the condensed vapor, a baffle having a plurality of apertures therein extending across said tank above a gas inlet tube discharge end and below the condensed vapor level such that the gas bubbles through the apertures and the condensed vapor, whereby the bubbles of gas passing through the condensed vapor become saturated, a manifold operatively connected with the gas outlet.

3. The apparatus as set forth in claim 1 further including a second material inlet for receiving a second fluid material, said second material inlet being connected with the mixing chamber, whereby the pressure drop in the mixing chamber tends to draw the second fluid material into the mixing chamber.

4. The apparatus as set forth in claim 1 further including a source of gas with condensable vapor entrained therein operatively connected with said gas inlet.

5. The apparatus as set forth in claim 1 wherein said corona electrode includes a metallic disc having a plurality of orifices therein and a needle projecting downstream from the disc, said orifices being disposed in communication with the gas inlet.

6. The apparatus as set forth in claim 5 further including a constricted throat portion disposed around said needle, whereby gas with entrained vapor is forced closely adjacent said needle and accelerated as it flows from the inlet toward said mixing chamber.

7. The apparatus as set forth in claim 6 wherein said attractor electrode includes a conductive sleeve having an electrode internal passage therethrough, the conductive sleeve being disposed with its electrode internal passage in communication with said throat such that gas flowing through said throat flows through the electrode internal passage.

8. The apparatus as set forth in claim 1 wherein the first material entraining outlet is annular and is connected with the first material inlet by a first annular passage extending along an outer periphery of the dielectric tube such that the first material particles are drawn across the dielectric tube outer periphery to remove any charge accumulation therefrom.

9. The apparatus as set forth in claim 8 further including a second material inlet operatively connected with a second annular passage disposed peripherally around the first annular passage and terminating adjacent the dielectric tube downstream end in an annular second material outlet.

10. The apparatus as set forth in claim 1 wherein the dielectric passage diverges from the electrodes to the downstream end and wherein the mixing chamber transverse cross section diverges from adjacent the dielectric tube to a discharge end.

11. The apparatus as set forth in claim 10 further including an outlet nozzle linearly aligned with the dielectric passage and the mixing chamber and disposed adjacent and downstream from the mixing chamber, the outlet nozzle having a larger transverse cross section than the mixing chamber such that an additional pressure drop occurs between the mixing chamber and the outlet nozzle causing further turbulence and condensation as the gas and first material are discharged directly to the atmosphere.

12. The apparatus as set forth in claim 1 wherein the first fluid material is a powder.

13. The apparatus as set forth in claim 1 wherein the first fluid material is a liquid.

14. An electrogasdynamic apparatus comprising:

an air inlet for receiving an air flow having a condensable vapor entrained therein;

corona and attractor electrodes disposed in communication with said air inlet, the electrodes being adapted to be connected with a source of electrical potential for applying a potential difference across said electrodes to ionize the vapor;

a dielectric tube having an unrestricted internal dielectric passage extending downstream from said corona and attractor electrodes, with a first end which is in communication with the air inlet and the electrodes for conducting the flow of air entrained with vapor ionized by the electrodes therethrough from its first end to a second end, the dielectric tube having an outer peripheral surface adjacent the second end;

a material inlet which is adapted to be connected with a source of fluid material, said material inlet including an annular material passage which extends along the dielectric tube outer peripheral surface removing charge accumulation therefrom and terminates surrounding the dielectric passage second end in an annular aspiration outlet; and, an unrestricted mixing chamber disposed in alignment with and adjacent the dielectric passage second end such that the air flow entrained with vapor ionized by the electrodes pass through the mixing chamber directly to the atmosphere, the mixing chamber having a larger transverse cross section than the dielectric passage such that a pressure drop occurs between the dielectric passage and the mixing chamber to aspirate particles of the fluid material from the annular aspiration outlet into the flow of air entrained with ionized vapor such that the flow of air entrained with ionized vapor and fluid material particles are mixed downstream from the electrodes, the pressure drop tends to cause the vapor to condense on the fluid material particles and to cause turbulence, whereby the fluid material is charged indirectly and the electrodes remain free from being coated by the fluid material.

* * * * *